US005400546A

United States Patent [19]

Christian et al.

[11] Patent Number: 5,400,546

[45] Date of Patent: Mar. 28, 1995

[54] PRECISION TWIST DRILL SHARPENER/POINT SPLITTING MACHINE

[75] Inventors: William C. Christian; David A. Bernard, both of Ashland, Oreg.

[73] Assignee: Darex Corporation, Ashland, Oreg.

[21] Appl. No.: 34,894

[22] Filed: Mar. 19, 1993

[51] Int. Cl.[6] ..... B24B 3/24

[52] U.S. Cl. ..... 451/143; 451/140; 451/138; 451/48

[58] Field of Search ..... 51/88, 89, 93, 94 CS, 51/95 R, 95 WH, 96, 219 R, 219 PC, 218 T, 217 T, 232, 288, 92 R, 94 R, 97 R, 234

[56] References Cited

U.S. PATENT DOCUMENTS 2,109,308 2/1938 Adams ..... 51/94
4,001,975 1/1977 Bernard et al. ..... 51/5
4,471,581 9/1984 Bernard et al. ..... 51/219
4,485,596 12/1984 Bernard et al. ..... 51/219
4,916,866 4/1990 Bernard et al. ..... 51/95
5,097,634 3/1992 Hulme ..... 51/288
5,179,809 1/1993 Schroeder ..... 51/288

*Primary Examiner*—Jack W. Lavinder
*Attorney, Agent, or Firm*—Kerkam, Stowell, Kondracki & Clarke

[57] ABSTRACT

A twist drill sharpener employing a pair of rotary grinding wheels has three primary drill chuck receiving openings, one for alignment of the twist drill and cams on the twist drill chuck; a second receptacle for grinding the end of a chucked twist drill; and a third receptacle which receives the drill and chuck for grinding a split point on the sharpened twist drill.

6 Claims, 7 Drawing Sheets

PRECISION TWIST DRILL SHARPENER/POINT SPLITTING MACHINE

BACKGROUND OF THE INVENTION

There are a number of drill sharpener machines available today, some of which can sharpen common twist drills to the like-new drill geometry. However, many of such machines require rather skilled operators, and others only approach standardized drill geometry.

U.S. patents directed to drill sharpener machines and attachments, such as twist drill chucks, include: U.S. Pat. No. 4,916,866, Bernard et al; U.S. Pat. No. 4,485,596, Bernard et al; U.S. Pat. No. 4,471,581, Bernard et al; and U.S. Pat. No. 4,001,975, Bernard et al.

It is a primary object of this invention to provide a super precision drill sharpener technology so advanced that the machine takes all guesswork and most of the operator involvement out of twist drill sharpening.

Historically, common twist drills have been a very standardized tool. The geometry at the cutting end was a standardized geometry, generally selected by the Metal Cutting Tool Institute as the best geometry for all general purpose drilling, and had an included point of 118°, a lip relief of 6° to 18° (depending on drill diameter), and a chisel edge accurate to within 0.004 inch with the axis of the drill. In recent years, many new drill point geometries have become commonly used for special and general purpose drilling. The most prominent variations of the standard 118° point are the 118° "S" or Spiral point, the 135° split point, or a combination of the two. In addition, a higher degree of chisel edge accuracy, down to 0.002 inch, is becoming more common. These new points are being used more and more because of their superior cutting ability, self-centering characteristics and ability to produce more accurate holes. Currently, about 30% to 40% of all twist drills produced in the United States are made with one of these point variations. Drills with the traditional standard point geometry, or the other mentioned variations, are purchasable at hardware stores and industrial supply distributors by homeowners, hobbyists, auto mechanics, building tradesmen, millwrights and machinists.

Good-quality, high-speed, steel twist drills are expensive; for example, the average current list price for ⅛-inch size, with a traditional 118° point, is about $0.60; for 5/16-inch size, about $1.75; and for ½-inch size, about $4.00. Drill prices with "special" drill points are usually double in cost. Yet, only a very small percentage of the twist drills purchased are ever resharpened, because it is very difficult for even a master machinist to resharpen the cutting lips by hand and produce the most efficient geometry. Generally, drills resharpened by hand remove material inefficiently, quickly become overheated, lose their sharpness and are soon scrapped.

For these reasons, thousands of small manufacturers scrap a number of twist drills per day at an estimated average cost of $2.00 per each drill. Such loss can amount to a hundred or more dollars per week per manufacturer.

The size of possibly not less than 95 percent of all twist drills manufactured and used is within the range of 1/16 inch and 1 inch in diameter, and within this range, there are 64 fractional-inch sizes, 26 letter sizes, 56 numeral sizes and 145 millimeter sizes, and one of the main objects of this invention is to provide a drill sharpener whereby all of these different sizes of drills, about 300 in all, can be handled by one super precision drill sharpener mechanism.

SUMMARY OF THE INVENTION

The drill sharpener of the invention produces the required configuration of movements at the cutting end of twist drills during the sharpening operation to quickly, accurately and simultaneously grind and sharpen the cutting lips of two flute-twist drills to a preferred drill point angle, and to preferred lip relief angles, and very accurately locate the center of the chisel point with the center of the drill by simply manually rotating a chuck containing the drill in a fixture as the cutting end of the drill is manually pressed against a rotating grinding wheel.

In regard to the standardized geometry, it is pointed out that the relief angle of the two cutting lips increases from the periphery to the center of the drill. For example, a relief angle referred to as 12° is the relief at the peripheral end of the cutting lips, and this 12° gradually increases.

In general, the invention includes a small, lightweight housing on which is mounted an electric motor which mounts, for example, a 118° or 135° cutting wheel.

The assembly includes separately handled drill chucks which are able to grip the drill securely on the flutes of the drill and close enough to the point to prevent vibration during the grinding operation. The drill chucks mount two cams integral with each other.

A fixture supported by the housing has two purposes, namely, (1) to establish an exact dimension between the tip of the drill and one of the two integral cams before the drill is gripped by the jaws of the chuck, and (2) to very accurately align the two cutting lips of the drill with the cams before the chuck is tightened to lock the drill to the body of the chuck.

In addition, the assembly includes a second fixture used for producing the required geometry at the cutting end of the drill during the sharpening operation. The second fixture has a sleeve into which the drill chuck is inserted after the two lips of the drill are aligned with the two integral cams on the chuck.

The fixture is spring-hinge mounted on the housing, and by merely applying a light push force on the chuck as the chuck is manually rotated clockwise in the fixture, one cam follower follows the face of one of the two integral cams which feeds the end of the drill toward the grinding wheel while, simultaneously, a second cam follower following the face of the second integral cam swings the end of the drill away from the face of the grinding wheel. As will be more fully described hereinafter, it is by feeding the end of the drill toward the grinding wheel with one cam, while simultaneously using a second cam to swing the end of the drill away from the wheel, which produces the relief angle.

In addition, the assembly includes a third fixture used for producing a split point at the cutting end of the drill. The third fixture has a sleeve into which the drill chuck is inserted after the two lips of the drill are aligned with the two integral cams on the chuck and the drill is sharpened in the second fixture.

BRIEF DESCRIPTION OF THE DRAWINGS

The invention will be described in greater detail in reference to the accompanying drawings, wherein.

DETAILED DESCRIPTION OF THE INVENTION

Figure 1:
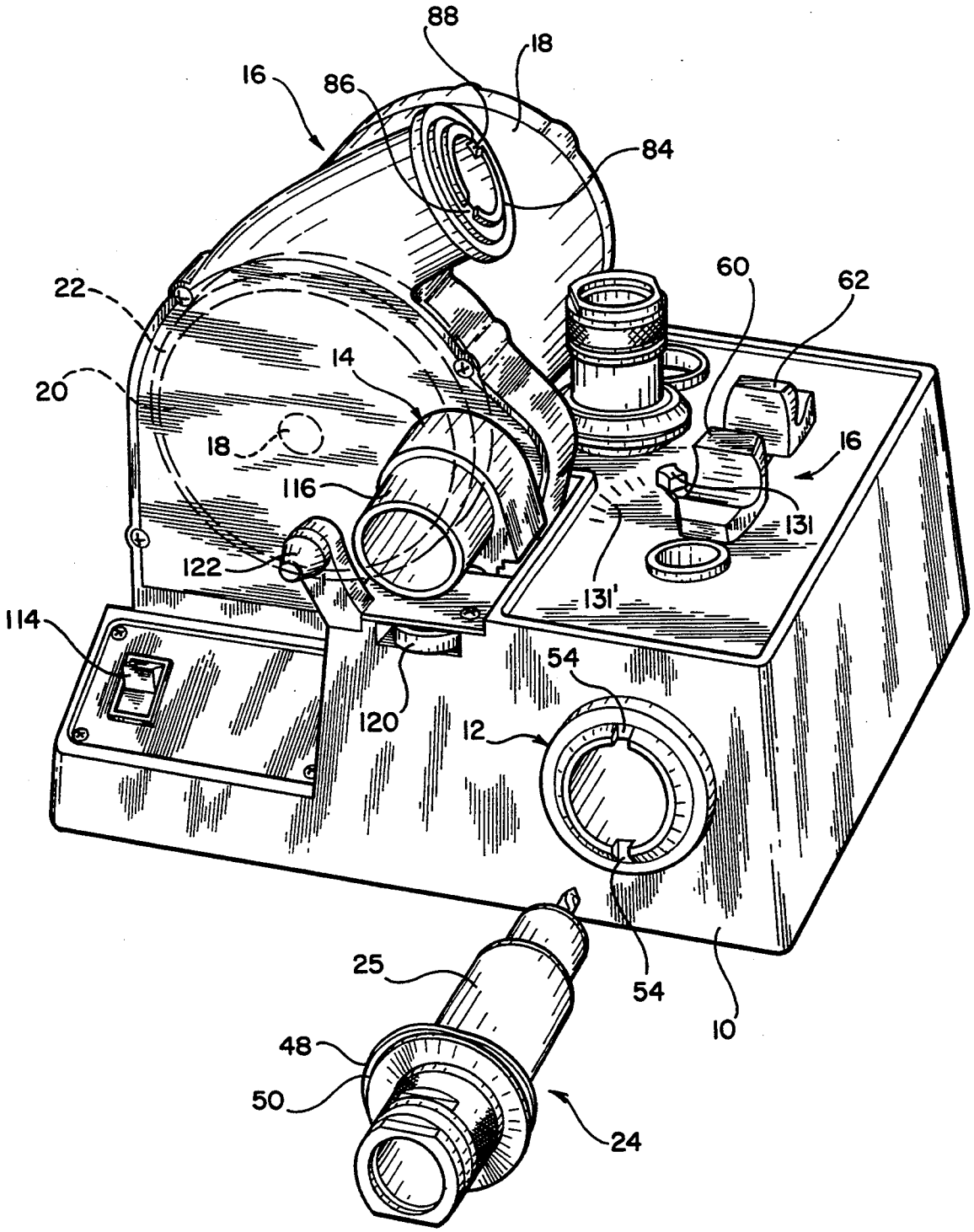
FIG. 1 is a perspective view of the arrangement of the principal elements of applicant's improved drill sharpening machine.
Figure 4:
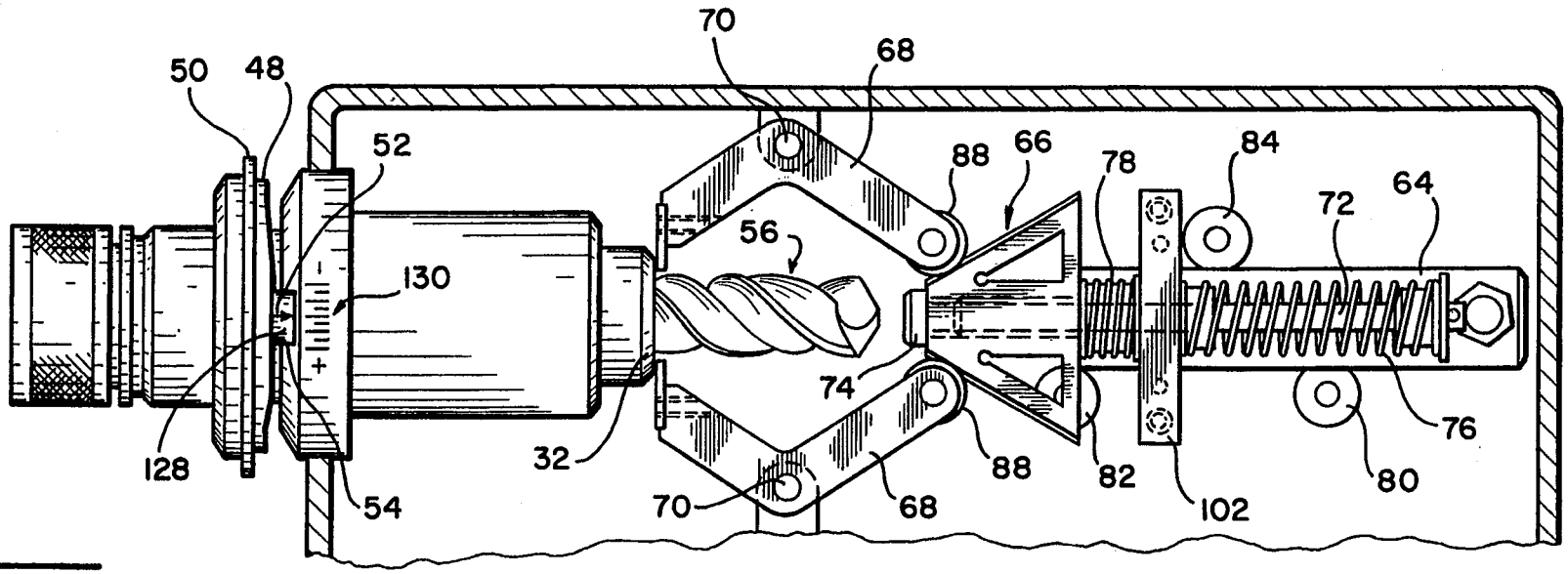
FIG. 4 is a sectional view on line 4—4 of FIG. 3.

Referring to FIG. 1, 10 is a cast housing, or base, for the drill sharpener showing the location of the timing tube receptacle 12, the point sharpening receptacle 14, the drill point-splitting receptacle 16, and the electric motor housing 18 for the grinding and/or cutting wheel.

Figure 8:
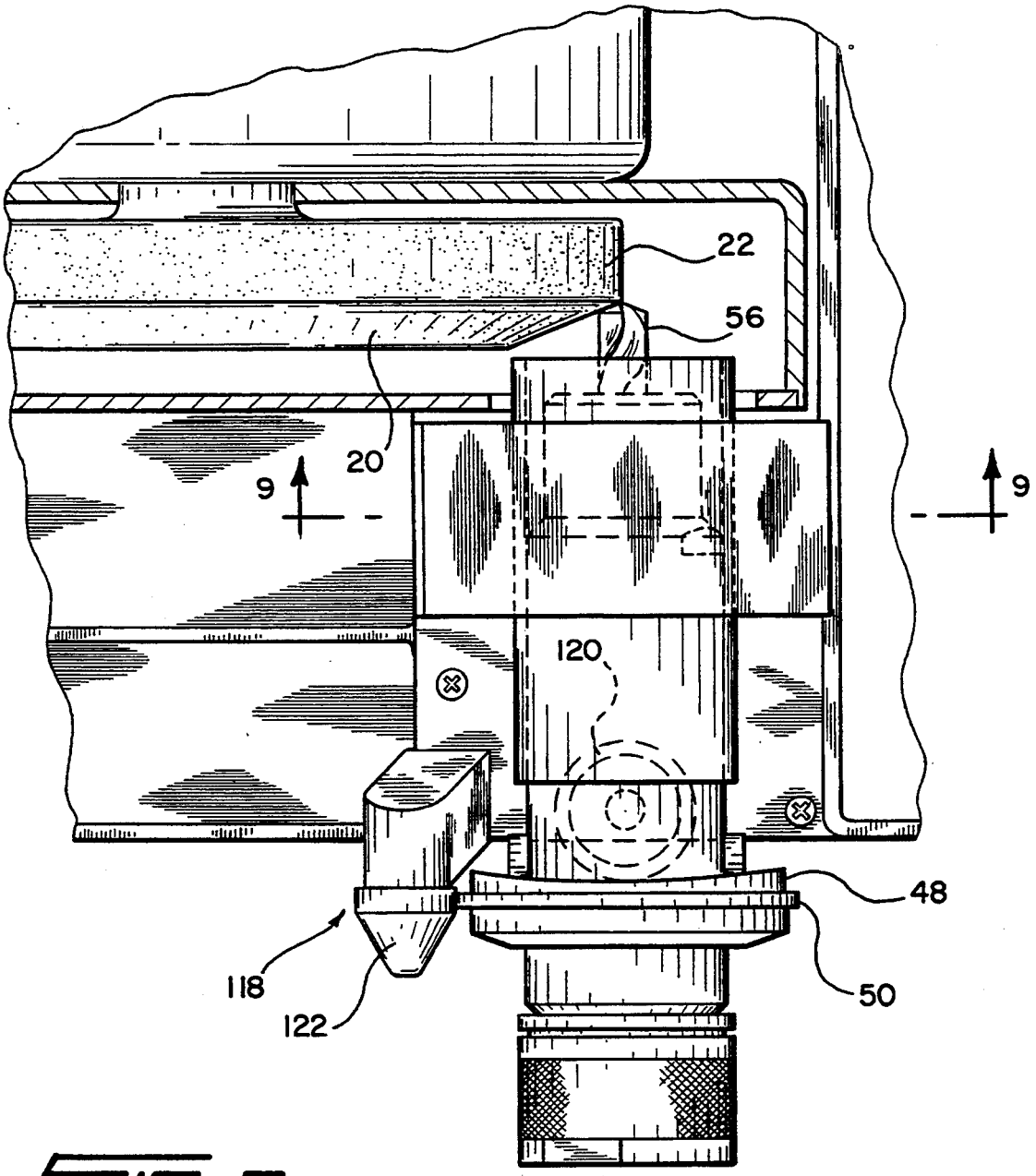
FIG. 8 is a view substantially on line 8—8 of FIG. 7.

The motor output shaft and hub support a pair of metal cutting wheels 20 and 22. Wheel 20, best seen in FIG. 8, has an angular cutting surface which may be formed, for instance, at 118° or 135° to the motor shaft. The cutting surface has applied thereto Borazon or diamond grit, depending on the primary duty of the sharpener. If the sharpener is to be used for conventional twist drills, Borazon cutting grit is electroplated on the cutting surface, whereas if the primary function of the drill sharpener is for sharpening carbide drills, it is preferable that the cutting material comprise diamond grit.

Figure 2:
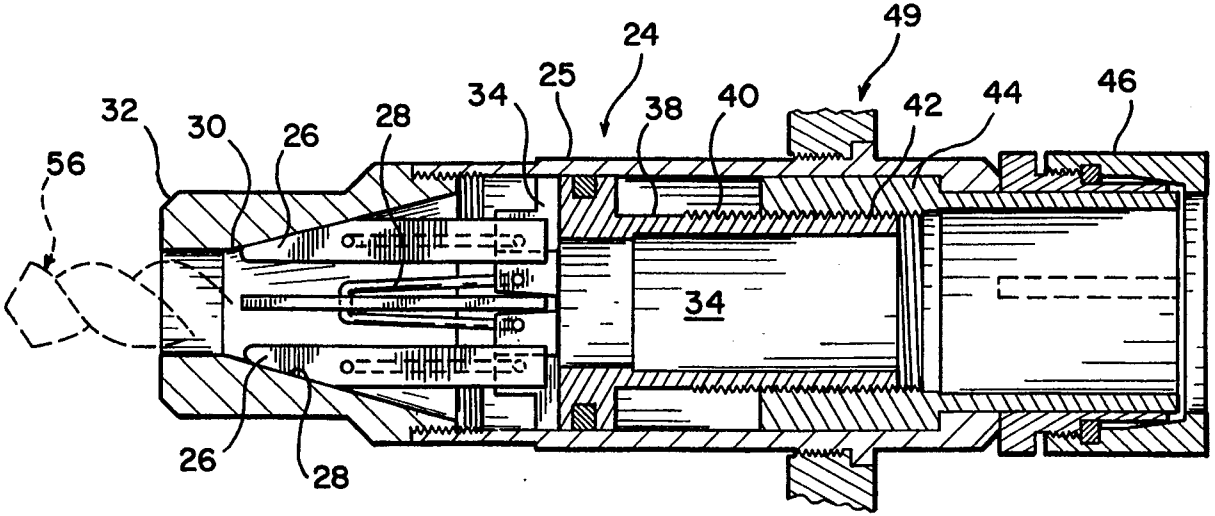
FIG. 2 is a sectional view through a drill holding and cam receiving chuck.
Figure 10:
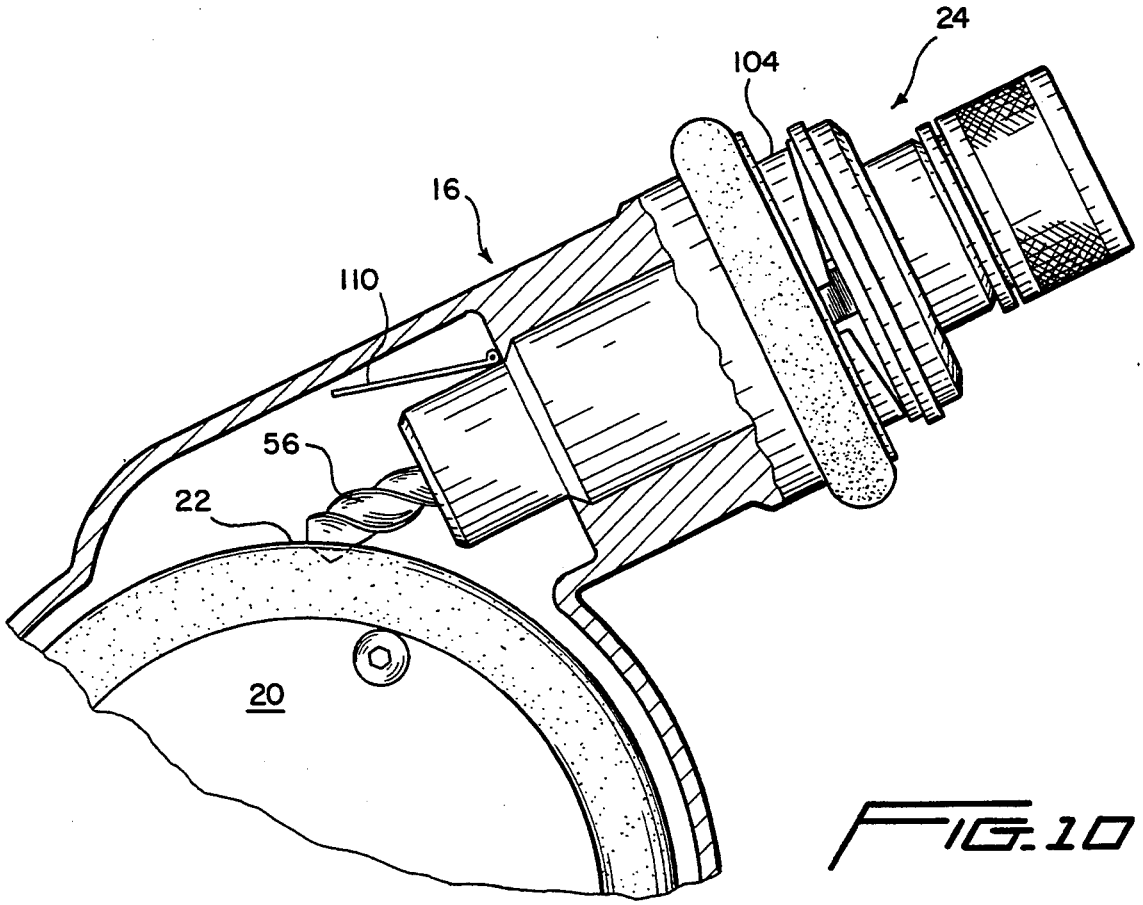
FIG. 10 is an enlarged, partial, fragmentary view of the drill point-splitting feature of the invention.
Figure 11:
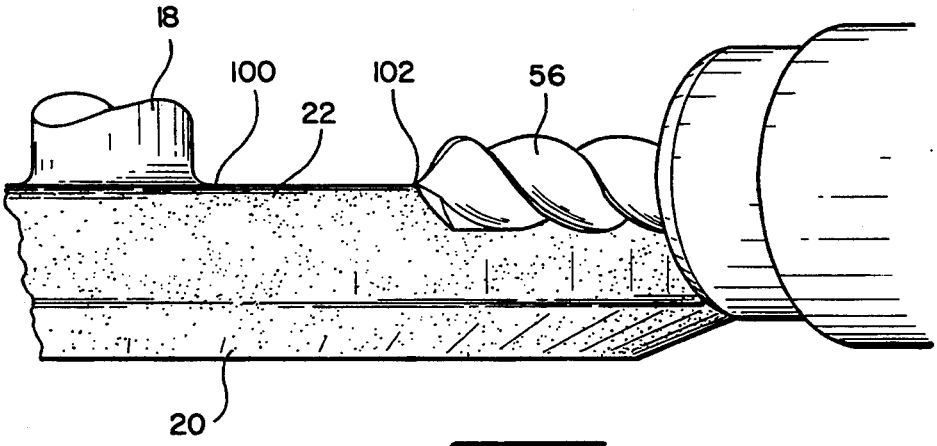
FIG. 11 is a fragmentary view looking toward the peripheral surface of a grinding wheel for performing the point-splitting function of the improved drill sharpening tool.

The second cutting wheel 22 has a peripheral surface, having bonded thereto either Borazon or diamond grit. The relationship between the cutting surface of the wheel 22 and the drill bit, henceforth designated 56, is best shown in FIGS. 10 and 11. Borazon is a cubic form of boron nitride and will very satisfactorily cut or grind steel bits. One of the required features of the present invention is the drill chuck 24. The drill chuck includes a barrel portion 25, internally of which are housed a plurality of chuck jaws 26 and chuck jaw springs 28. In the illustrated chuck, FIG. 2, there are shown four chuck jaws 26. However, on larger size chucks for handling larger diameter drills, the number of jaws may preferably be increased to six or eight. The chuck jaws 26 have sloping faces 28, which cooperate with the sloping faces 30 on the chuck nosepiece 32. The jaws of the chuck are mounted to an internal barrel 38 by jaw springs 28. The internal barrel 38, having threads 40, is urged toward the chuck nose 32, or away therefrom, by rotation of the end piece 44–46, having threads 42 mating with threads 40.

The chuck 24 also has secured thereto a removable pair of cam surfaces 48 and 50 which, as to be more fully described hereinafter, cooperate with cam followers which determine the drill point configuration. The cam surfaces are best illustrated in, for example, FIGS. 3, 4, 5, 7, and 9. The drill chuck 24 mounts two cams integral with each other, generally designated 49. The cam 48 also has associated therewith a stop member, or dog 52, which engages in one or both of a pair of cooperating openings 54, best shown in FIG. 1 of the drawing. The ring comprising the chuck and drill alignment fixture 12 is manually adjustable to provide for slight variations in the drill point configuration, as shown best in Figures such as FIG. 3. Normally, no adjustment of the chuck and drill alignment fixture is required for proper operation of the drill sharpening device.

In operation of the drill aligning means, the drill 56 is loosely chucked such that there can be movement between the drill 56 and the chuck body. Further, the drill is inserted in the chuck to extend beyond the face 32 of the chuck a distance greater than would be anticipated, and a good rule to follow is to position the drill at least one full spiral length beyond the front end of the chuck.

Then, with the drill and chuck positioned as above, the chuck and drill are inserted in the fixture 12 with the elements 52 and 54 cooperating to prevent further rotation of the chuck. When so positioned, the pair of finger engaging elements 60 and 62, FIGS. 1 and 3, are spread their maximum distance and the internal mechanism is positioned as illustrated in FIG. 3.

During drill alignment, with the finger grip element 62 being urged toward the fixed finger grip element 60, the alignment pusher bar is caused to move toward the chuck and in so doing moves the pusher wedge 66 into engagement with the pair of pawl arms 68. The pawl arms are pivotally mounted to the housing at pivot pins 70, as more clearly illustrated in FIG. 3. Continued motion of the pusher bar 64 and pusher rod 72, having drill engaging end element 74 at its end, causes compression of pusher bar return spring 76 and release in the tension in the pusher guide spring 78. To insure that movement of the pusher bar is parallel to the chuck and drill 56, the bar engages bearings 80, 82 and 84. Further, to insure smooth operation of the pusher wedge and the pawl arms 68, the ends 86 of the pawl arms have roller bearings 88 associated therewith, which roller bearings engage the sloping surfaces 90 of the pusher wedge. As the pawl arms 68 ride on the wedge surfaces 90, the ends 92 of each pawl arm having attached thereto pawls 94, which in a preferred embodiment comprise carbide, are urged toward the drill bit flutes.

Figure 3:
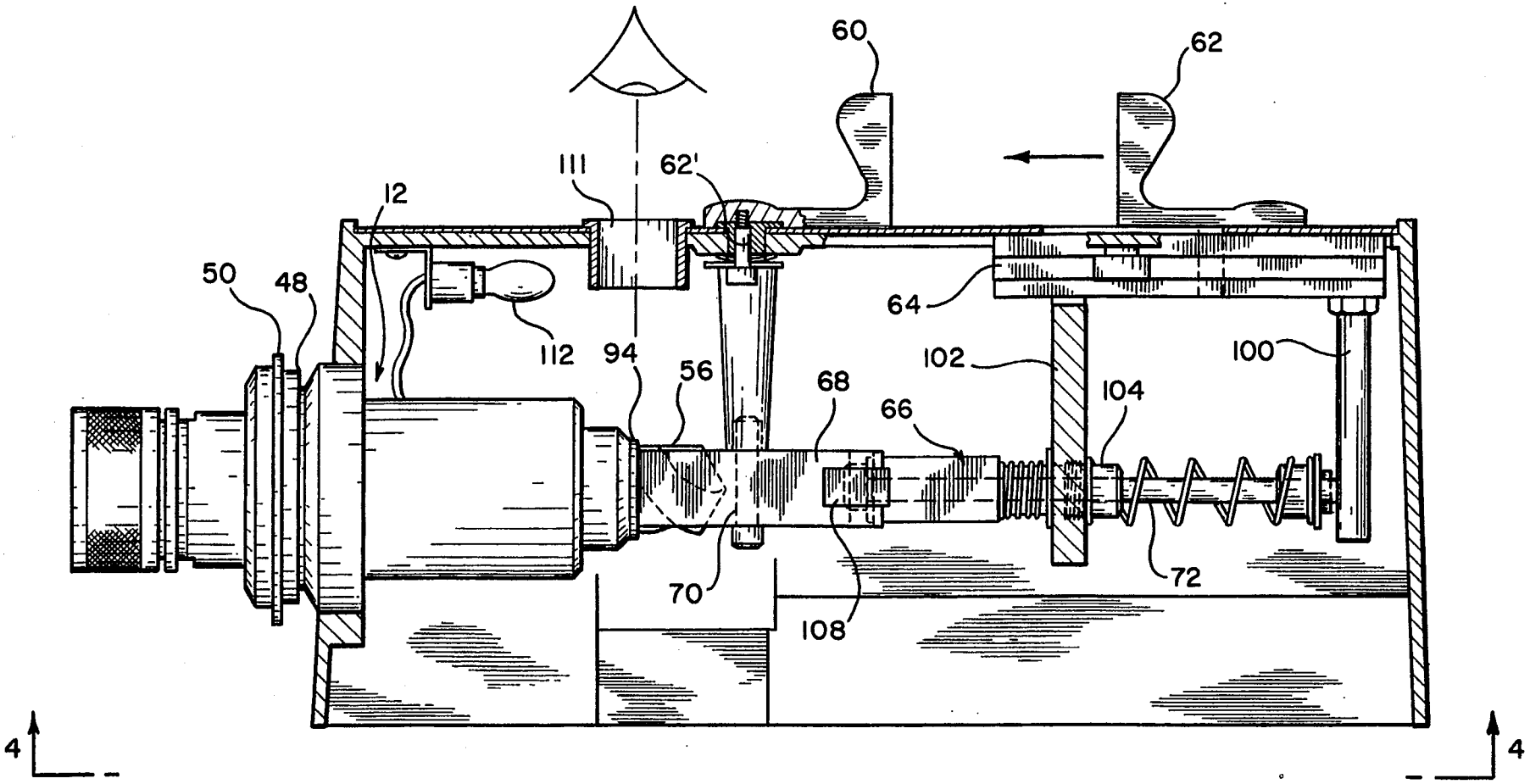
FIG. 3 is a partial, sectional view through the drill positioning fixture of the drill sharpener in relation to the drill holding chuck.

In FIG. 3 of the drawings, the proper relationship between the pusher bar 64, its bearing supports, and the pusher rod is illustrated. It will be seen from FIG. 3 that connected to the pusher bar, and depending therefrom, is a pin 100 and a plate 102. The plate 102 is fixed to the housing, whereas the pin 100 moves with the pusher plate. Through an opening in the plate 102 is a guide bearing 104, through which the pusher bar 72 slides. The pusher bar 72 passes through a bore in the pusher wedge so that when the wedge 66 reaches its travel extent in that the carbide pawls 94 are engaged in the drill flutes, as shown for example in FIG. 6, the bar can continue to travel until the finger grips 60 and 62 are in contact, thus positioning the length of the drill 56 protruding from the forward end 32 of the chuck 24. Further, there is illustrated a spring 108, FIGS. 5 and 6, which is the pawl return spring, and which, during operation, keeps the pawls and their rotary bearings 88 in contact with the sloping surfaces of the pusher wedge 66 having the sloping surfaces 90. Inward movement of the ends 92 of the pawl arms 68 eventually brings the carbide pawls 94 into contact with the drill, and further movement of the pawl arms can only take place after the pusher rod 72 urges the drill 56 rearwardly and such movement causes the drill to slide back until the carbide tips 94 can fall into the flutes of the drill. Once the carbide tips 94 are engaged in the flutes, they are held in this position by the force of pusher guide spring 78 acting against the force of the pawl return spring 108 to push the wedge 66 against the pawl arms 68 forcing the carbide tips to stay in the flutes. With the pawls 94 engaged in the flutes, continued rearward urging of the drill by the pusher rod 72 causes the drill to rotate, which it continues to do until the pusher rod reaches the end of its travel.

Figure 6:
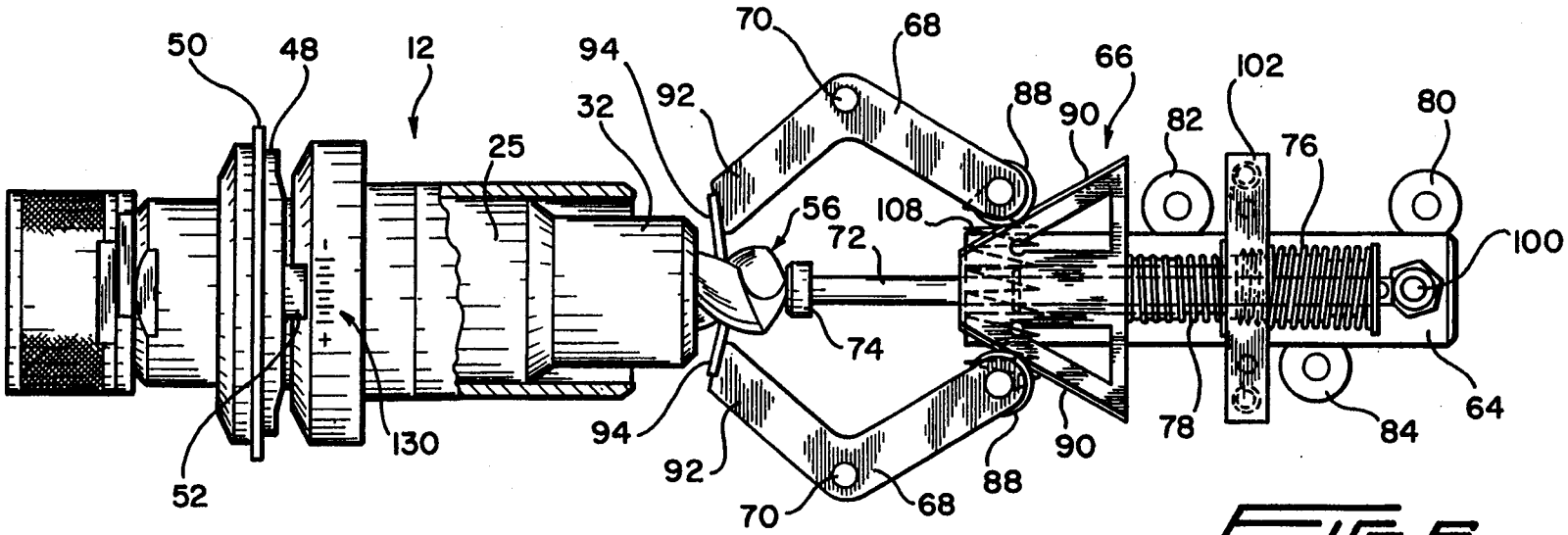
FIGS. 5 and 6 are views like FIG. 4, showing further positions of the drill in relationship to its chuck.
Figure 5:
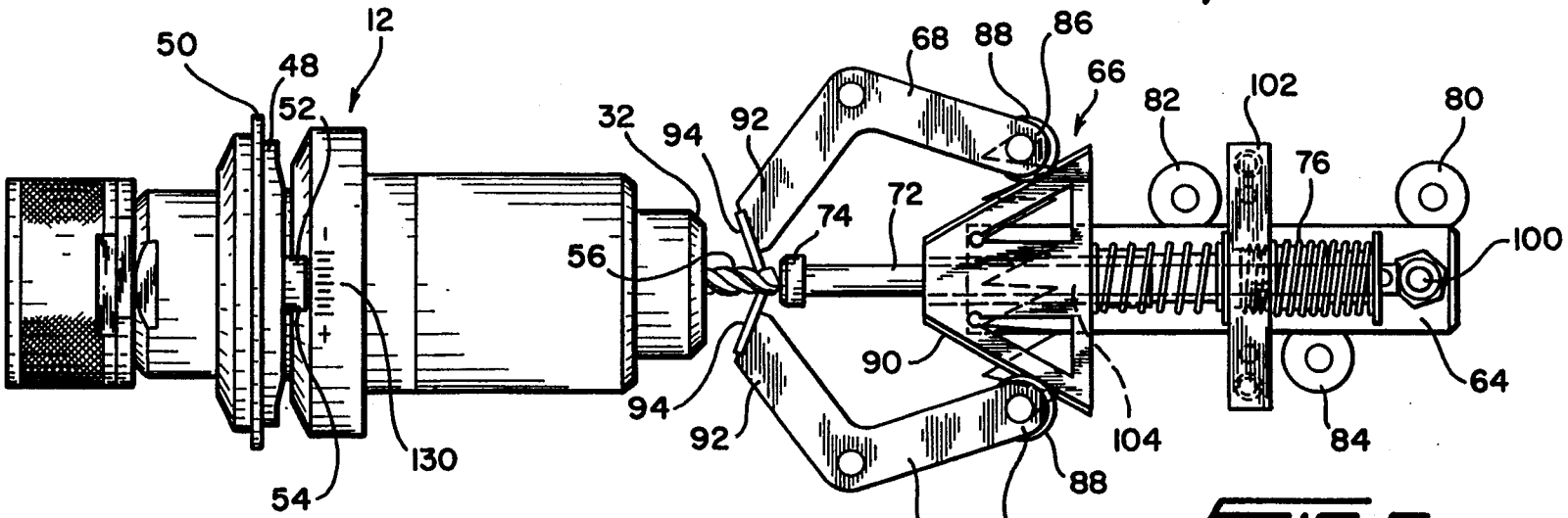
Figure 7:
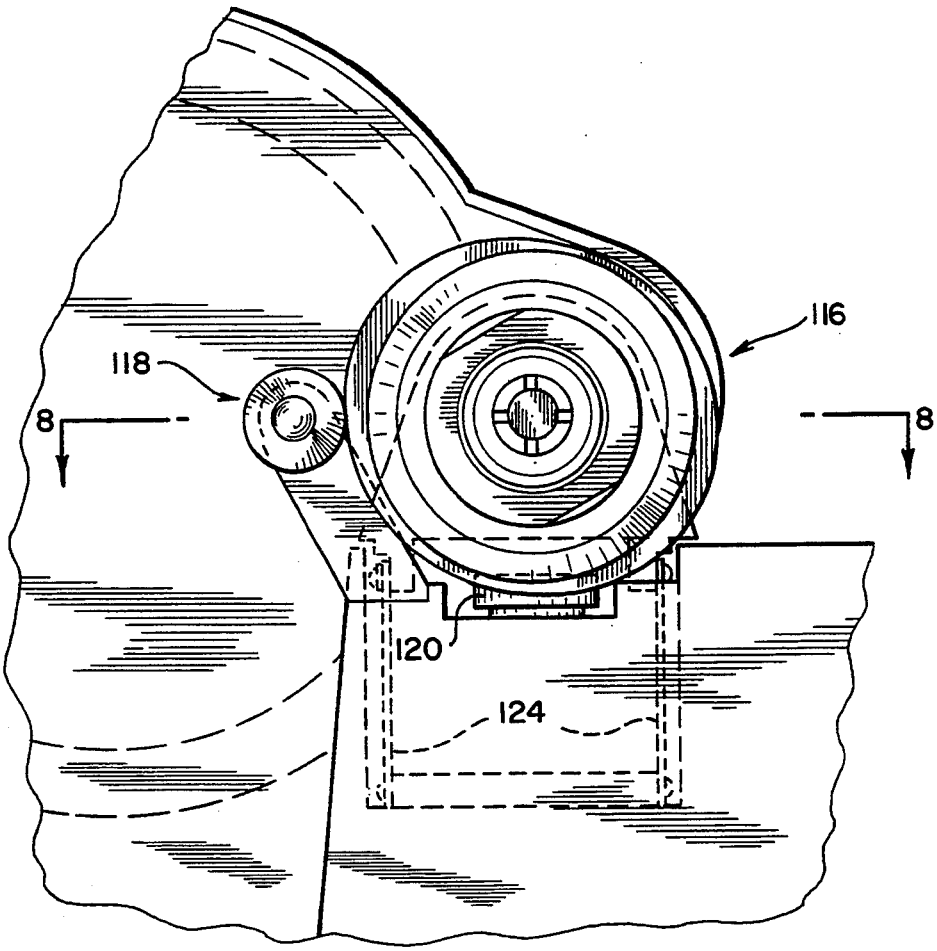
FIG. 7 is a partial, fragmentary view of a fixture for cutting a drill employing an angular portion of the grinding wheel.
Figure 9:
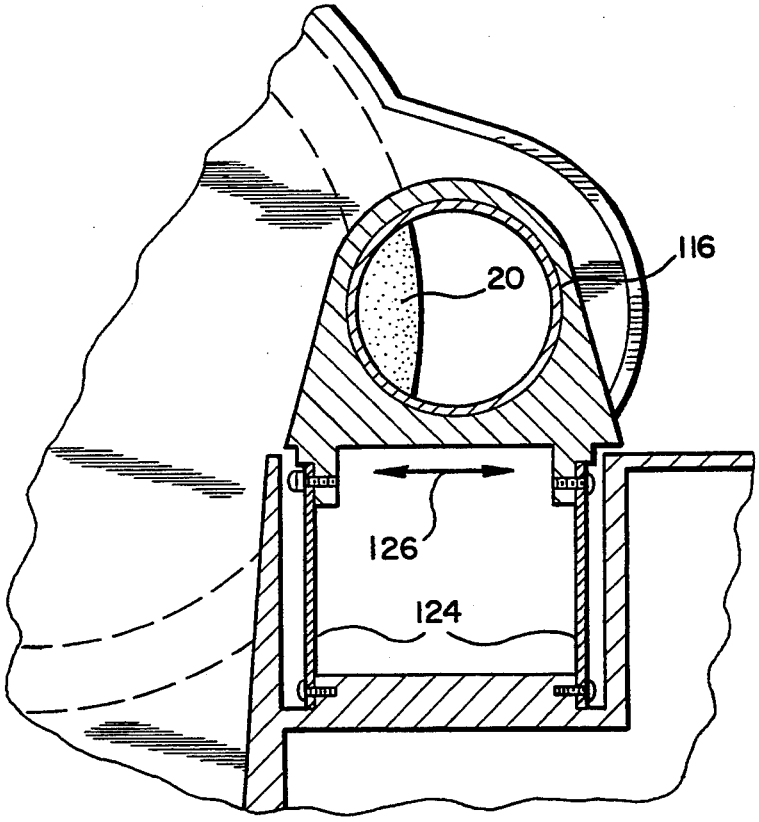
FIG. 9 is a section substantially on line 9—9 of FIG. 8.

At this point, the drill is positioned in the correct axial and radial position in relation to the chuck cams, as illustrated in FIG. 6. The chuck 24 is then tightened, immobilizing the drill bit 56 in the desired aligned relationship.

Immobilization of the drill bit in respect to the chuck 24, permits removal of the chuck and bit from the fixture 12 and placement of the chuck in the fixture 14.

Prior to removing the chuck from fixture 12, it is advantageous to look through the sight opening 110 so that the operator can visually inspect the position of the pawls 94, the drill flutes and the position of the drill tip in respect to the end of the chuck. Inspection is enhanced by the electric light 112, which is energized at the time of energizing the motor 18 by the switch 114, FIG. 1 of the drawings.

With the drill 56 properly aligned and secured in the chuck 24, the chuck and secured drill are inserted in grinding fixture 14. Grinding fixture 14 is illustrated in FIGS. 1, 7, 8 and 9 and includes a receptacle 116 which snugly receives the barrel portion 25 of the chuck. One of the cams 50 on the chuck engages cam follower 118, while the other cam 48 is engaged by cam follower designated 120, comprising a roller element.

Cam guide 122 allows cam 50 to easily slide onto cam follower 118 when the chuck is inserted into fixture 14.

As the chuck is rotated in fixture 116, the following takes place:

1. The cam 48 and the cam follower 120 cause the chuck and its attached drill to move outwardly from its most inwardly position, shown in FIG. 8, where the beveled grinding surface 20 of the cutting wheel faces the point area of the drill bit; and 2. The cam 50 and roller cam follower 118 cause the chuck and drill bit to move angularly with respect to the axis of rotation of the cutting wheel.

These two movements contour the cutting tip of the drill to its proper configuration.

The latter motion of the chuck and drill is simply brought about by a pair of leaf springs 124, which support the fixture 116, permitting outward and inward flexure as illustrated by the directional arrow 126. Thus, the two cams, in cooperation, result in proper sharpening of the twist drill, without control being required of the operator other than an inward force and a rotating force on the drill chuck.

In the event a greater or lesser amount of relief of the cutting edge of the drill is desired, the timing tube receptacle 12 is loosened by means of two locking screws and rotated towards the plus or minus markings, generally designated 130 on the drill positioning fixture. For instance, the timing tube is rotated toward the plus side for more relief for drilling softer materials, and moved in the opposite direction for less relief for drilling harder materials.

In the event a greater or lesser amount of the grinding of the drill is required, or desired, the material removal arm 131 is moved toward the less or more markings. Moving this lever moves the position of the fixed finger grip element 60 slightly towards or away from the finger grip element 62, via cam 62'. Since finger grip 60 acts as the stop for finger grip 62 and ultimately pusher rod 72, slightly adjusting it allows the drill to protrude slightly more or less out of the end of the chuck, allowing more or less to be ground off. The lever is moved in the more direction if the cutting edges of the drill are badly damaged and moved in the opposite direction if only a very limited amount of material is required to be removed from the drill to fully sharpen it.

As previously indicated, the precision twist drill sharpening device is provided with a further novel feature, that is, the sharpener is designed to create a split point on the drill bit, using the identical chuck and drill that has been previously sharpened in the sharpening tool. The point split port is designated 16, and is shown in FIG. 1, and the details thereof are shown in FIGS. 10 and 11.

In U.S. Pat. No. 4,485,596, there is disclosed a form of point splitting and web thinning, together with pictorial showings of the effects of point splitting in FIGS. 18 and 20.

In point splitting, the grinding wheel 22 is employed, and the grinding wheel 22 is positioned on the motor arbor 18, such that an edge 100 of the grinding wheel 22 is aligned with the point 102 of the twist drill 56. The point splitting fixture 16 is provided at its outer periphery with a ring 104, having depressed portions 106 and 108 which receive the dogs 54, as more clearly shown in FIGS. 5 and 6. Thus, the dogs function in both the aligning receptacle 12 and the point splitting receptacle 16. With the chuck properly positioned in the fixture 16, gentle rocking of the chuck and its fixture 16, the chuck assembly, collectively the chuck and fixture, will grind the drill on one of the flute ends. The chuck is then removed from the fixture and rotated 180° and repositioned with the dogs in the appropriate slots in the fixture. Gentle rocking then brings about the final point splitting of the twist drill. As illustrated in FIG. 10, a closure plate 110 covers the chuck and drill port when the split point fixture is not in use, thereby reducing to a minimum dispersement of metal particles.

We claim:

1. A twist drill sharpener, comprising a housing mounting; a motor having a horizontal motor-driven spindle; a grinding wheel made of metal, mounted for rotation on the spindle, said grinding wheel having a beveled peripheral grinding surface; a twist drill mounting chuck having a cylindrical barrel portion; a pair of peripheral cams carried by the barrel portion of the chuck, said housing defining at least two chuck receiving fixtures, said at least two fixtures including a first fixture for positioning a twist drill flute relative to one of the cams and positioning the end of the twist drill a fixed longitudinal distance from at least one of the two cams; a second fixture, said second fixture having a chuck receiving opening therein to position the chuck and twist drill in operative relation to the beveled grinding surface of said grinding wheel, further including a third fixture having an opening therein to receive the chuck and twist drill, said third fixture mounting said chuck and twist drill, tangential to a grinding surface on the grinding wheel, further wherein the grinding wheel associated with the third fixture has a peripheral grinding surface, wherein the first fixture includes a pusher rod for determining the longitudinal distance between the end of the twist drill and at least one of the chuck mounted cams.

2. The invention, defined in claim 1, wherein the aligning fixture includes an element having a pair of wedge-shaped surfaces, a pair of pivotally mounted pawl arms, and each of the pawl arms engaging a sloping surface of the wedge-shaped element.

3. The invention defined in claim 2, wherein each of the pivotally mounted pawl arms have connected thereto a pawl adapted to engage the flutes of a twist drill when the wedge-shaped element is urged toward the chuck.

4. The invention defined in claim 3 wherein the housing is provided with a sight opening for inspecting the final position of the twist drill relative to the chuck and the pawls of said pivotally mounted pawl arms.

5. The invention defined in claim 2, wherein the wedge-shaped member and the pusher rod are manually urged into the twist drill orienting relationship to the drill chuck.

6. A twist drill sharpener, comprising a housing mounting; a motor having a horizontal motor-driven spindle; a grinding wheel made of metal mounted for rotation on the spindle, said grinding wheel having a beveled peripheral grinding surface; a twist drill mounting chuck having a cylindrical barrel portion; a pair of peripheral cams carried by the barrel portion of the chuck, said housing defining at least two chuck receiving fixtures, said at least two fixtures including a first fixture for positioning a twist drill flute relative to one of the cams and positioning the end of the twist drill a fixed longitudinal distance from at least one of the two cams; a second fixture, said second fixture having a chuck receiving opening therein to position the chuck and twist drill in operative relation to the beveled grinding surface of said grinding wheel, wherein the second chuck receiving fixture is associated with a pair of cam followers adapted to engage the pair of cams carried by the barrel portion of the chuck, and wherein one of the cam followers urges the twist drill toward and away from the grinding surface of the grinding wheel, and the other of the cam followers urges the chuck mounted twist drill in a direction normal to the axis of rotation of the grinding wheel, and wherein the second receptacle is supported by a pair of leaf springs which permit transverse movement of the chuck as one of the cam followers engages one of the chuck mounted cams.

* * * * *